US005343806A

United States Patent [19]

Fricke et al.

[11] Patent Number: 5,343,806

[45] Date of Patent: Sep. 6, 1994

[54] SWIVELLABLE PRE-GRIPPER OF A SHEET-FED PRINTING PRESS AND METHOD OF OPERATION THEREOF

[75] Inventors: Andreas Fricke, Eberbach; Siegfried Kurtzer, Mannheim, both of Fed. Rep. of Germany

[73] Assignee: Heidelberger Druckmaschinen AG, Heidelberg, Fed. Rep. of Germany

[21] Appl. No.: 120,128

[22] Filed: Sep. 10, 1993

[30] Foreign Application Priority Data

Sep. 10, 1992 [DE] Fed. Rep. of Germany ..... 4230218

[51] Int. Cl.[5] ..... B41F 1/30

[52] U.S. Cl. ..... 101/408; 101/409; 101/410; 101/411; 271/277

[58] Field of Search ..... 101/408, 409, 410, 411, 101/415.1, 216–217, 212, 242; 271/82, 277

[56] References Cited

U.S. PATENT DOCUMENTS

| | | | |
|---|---|---|---|
| 1,709,812 | 4/1929 | Weide | 101/408 |
| 1,874,013 | 8/1932 | Kaddelawd | 101/411 |
| 2,004,812 | 6/1935 | Johnson | 101/408 |
| 3,463,484 | 8/1969 | Rudolph | 101/409 |
| 4,210,079 | 7/1980 | Raes | 101/242 |
| 4,370,928 | 2/1983 | Weisbach et al. | 101/411 |
| 4,759,290 | 7/1988 | Höll et al. | 101/409 |
| 5,076,165 | 12/1991 | Pollich | 101/408 |

FOREIGN PATENT DOCUMENTS

| | | | |
|---|---|---|---|
| 0006402 | 1/1980 | European Pat. Off. | 101/409 |
| 3037776 | 7/1981 | Fed. Rep. of Germany | 101/411 |
| 3736808 | 9/1988 | Fed. Rep. of Germany | 101/409 |
| 0187354 | 11/1983 | Japan | 101/411 |
| 0821210 | 4/1981 | U.S.S.R. | 101/408 |

*Primary Examiner*—Eugene H. Eickholt

*Attorney, Agent, or Firm*—Herbert L. Lerner; Laurence A. Greenberg

[57] ABSTRACT

Swivelling pre-gripper of a sheet-fed printing press having a sheet feeding table includes a swivel arm; a gripper carried by the swivel arm; a mutually cooperating roller lever and cam mechanism for, respectively, opening and closing the gripper; a device for cyclically swivelling the swivel arm of the pre-gripper to and away from the sheet feeding table; a device for cyclically opening and closing the gripper; a device for setting an instant of opening of the gripper for releasing a sheet gripped by the gripper in a closed condition thereof to a downline conveying device for accepting and transporting the released sheet; a device for setting, in a manner decoupled from the setting of the instant of opening, an instant of closing the gripper for gripping the sheet fed from the feeding table to the pre-gripper; one of the devices for setting the instant of opening and for setting the instant of closing of the gripper being disposed on the roller lever; and the other of the devices for setting the instant of closing and for setting the instant of opening of the gripper forming part of the cam mechanism for, respectively, opening and closing the gripper; and method for setting gripper opening and closing instants of the pre-gripper.

7 Claims, 4 Drawing Sheets

SWIVELLABLE PRE-GRIPPER OF A SHEET-FED PRINTING PRESS AND METHOD OF OPERATION THEREOF

The invention relates to a swivellable pre-gripper of a sheet-fed printing press as well as to a method of operation thereof which includes setting the instant of opening and the instant of closing thereof.

It has become known heretofore for paper sheets, which have been conveyed from a feed table by means of swivelling pre-grippers of a sheet-fed printing press and aligned on the feed table, to be accepted by closing gripper members of the pre-grippers, and for the gripped paper sheets to be accelerated in sheet-conveying direction by swivelling the pre-grippers, in order for the sheets then, by opening the gripper members on the pre-gripper, to be transferred to a downline-disposed conveying means for forwarding the sheets to a first printing unit. In order to permit the paper sheets, which were aligned on the feed table, to be fed in register as accurately as possible in the printing unit located downline, the sheets must be conveyed by the pre-gripper as precisely as possible at a predetermined printing-press angle. In this regard, it is important that there should be no phase deviations between the acceptance or take-over position of the paper sheet by the pre-gripper and the forwarding or transfer position of the paper sheet by the pre-gripper. Due to manufacturing and assembly or installation errors, e.g. in the opening or closing gear transmission, and due to consequent errors in the transmission behavior, it is possible, however, for such deviations to occur with respect to the as-installed opening and closing timings. In order to counteract this, the instants of time, respectively, at which the gripper opening and gripper closing occur are set at the end of the installation. Heretofore known for this purpose are pre-gripper systems in which, first of all, the instant of gripper opening is preset and, thereafter, the instant of closing is set, however, due to feedback from or reaction to the latter setting, the instant of gripper opening is again thrown out of adjustment. The instant of gripper opening is readjusted in a new setting operation. In a plurality of setting operations, an iterative optimization process permits a final setting to be made wherein the errors of the instant of opening and the errors of the instant of closing are, together, as small as possible. Due to the aforementioned feedback of the settings, however, there continues to remain yet an undesired high setting error as a result of manufacturing and installation errors relating to the opening and closing gear transmission. Even though improved by optimization, the error represents a random result with a broad error tolerance. When paper of a specific thickness is being printed, such setting errors cause an inaccurate, out-of-register transfer of the sheets. For example, paper sheets may be gripped by the pre-gripper before they have been completely aligned and, as a result thereof, the paper sheets may enter the printing unit at a slant. In order to ensure that the paper sheets have been completely aligned, it is necessary, in the case of such a printing press, to allow, in the calculations, for a longer alignment time than usual, as a result of which, correspondingly shorter times remain available for accelerating the paper sheets to the speed of the impression cylinder. The paper sheets are then subject to a greater acceleration, due to which there is an increased risk of the paper sheets slipping in the gripper and, also, the paper sheets are exposed to a higher level of load or stress. Furthermore, very high accelerations of the pre-gripper adversely affect the smooth running of the printing press. Particularly when a multiplicity of paper sheets pass through the printing press more than once and when printing-press speeds increase, the danger of a loss in quality is increased by both of these effects.

It is accordingly an object of the invention to provide a swivellable pre-gripper of a sheet-fed printing press and a method of operation thereof which permit, by the use of relatively simple means, more accurate conveying of sheets by the pre-gripper of the sheet-fed printing press.

With the foregoing and other objects in view, there is provided, in accordance with the invention, a swivelling pre-gripper of a sheet-fed printing press having a sheet feeding table, the pre-gripper comprising a swivel arm; a gripper carried by the swivel arm; a mutually cooperating roller lever and cam mechanism for, respectively, opening and closing the gripper; means for cyclically swivelling the swivel arm of the pre-gripper to and away from the sheet feeding table; means for cyclically opening and closing the gripper; means for setting an instant of opening of the gripper for releasing a sheet gripped by the gripper in a closed condition thereof to downline conveying means for accepting and transporting the released sheet; means for setting, in a manner decoupled from the setting of the instant of opening, an instant of closing the gripper for gripping the sheet fed from the feeding table to the pre-gripper; one of the means for setting the instant of opening and the means for setting the instant of closing of the gripper being disposed on the roller lever; and the other of the means for setting the instant of closing and for setting the instant of opening of the gripper forming part of the cam mechanism for, respectively, opening and closing the gripper.

In accordance with another aspect of the invention, there is provided a method for setting an instant of opening and an instant of closing of a gripper on a pre-gripper of a sheet-fed printing press, which comprises swivelling the pre-gripper into one position selected from a closing position and an opening position, respectively, of the gripper; setting the gripper, in a first setting, so that, in the selected position, the gripper just closes and opens, respectively; swivelling the pre-gripper into the other of the respective opening and closing positions; and, independently of the first setting and without any reaction on the first setting, setting the gripper in a second setting, so that, in the selected position, the gripper just closes and opens, respectively.

The reaction-free, mutually independent setting of the instant of gripper opening and of the instant of gripper closing permits an accurate setting of both operations, independently of possible installation and manufacturing errors relating to the opening and closing transmissions. The different arrangement of the means for setting the instant of opening and the instant of closing, on the one hand, on the gripper-opening lever and, on the other hand, as part of the cam transmission or drive for opening and closing the grippers, permits a precise setting at the particularly simple, reliable transmission or drive arrangement with good accessibility. Precisely aligned sheets can be accepted by the grippers without requiring additional make-ready time for ensuring the alignment thereof at a defined printing-press angle, and without deviation of the sheets from the defined printing-press angle for transfer to the downline conveying means. Sheet transfer takes place in-register. This has a particularly advantageous effect upon the quality of printed sheets which are printed more than once in the printing press.

In accordance with another feature of the invention, the cam mechanism includes a uniformly rotatably driven opening cam, the roller lever is swivellably mounted and carries a sensing roller which is in continuous contact with the opening cam; a closing cam is carried by the roller lever; a gripper-opening lever is carried by the swivel arm of the pre-gripper; and a sensing roller is rotatably mounted on the gripper-opening lever, the sensing roller being in continuous contact with the closing cam. This construction provides for a coupled opening and closing of the pre-gripper grippers, while also providing a possibility of a decoupled setting of the instant of opening and the instant of closing of the grippers.

In accordance with a further feature of the invention, the closing cam carried by the roller lever is swivellable about a pivot point and settable and lockable for opening the gripper, and the sensing roller mounted on the gripper-opening lever is held in an eccentric, and means are included for setting and locking the eccentric on the gripper-opening lever.

In accordance with an added feature of the invention, the closing cam is swivellable about a pivot axis on the swivellably mounted roller lever; and means are included for swivelling and for locking the closing cam on the roller lever; the pivot axis, in the open condition of the gripper, coinciding with an axis of the sensing roller, and the sensing roller being in contact with the closing cam.

In accordance with an additional mode, the method according to the invention includes swivelling the pre-gripper into the opening position; setting the gripper, in a first setting, so that it just opens; swivelling the pre-gripper into the closing position; and, independently of the first setting and without any reaction on the first setting, setting the gripper then in a second setting so that, in the closing position, the gripper just closes.

In accordance with a concomitant mode, the method according to the invention, wherein the pre-gripper includes an opening cam, a closing cam and a sensing roller in continuous contact with the closing cam, further includes, in the swivelling of the pre-gripper into the one position selected from the respective opening and closing positions, swivelling the closing cam and the opening cam, respectively, about a point assumed by a sensing roller of the gripper on the closing cam and opening cam, respectively, in a coordinate system movable with the respective opening cam and closing cam and having an origin in a swivelling axis of the closing cam at the first setting.

Other features which are considered as characteristic for the invention are set forth in the appended claims.

Although the invention is illustrated and described herein as embodied in a swivellable pre-gripper of a sheet-fed printing press and a method of operation thereof, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
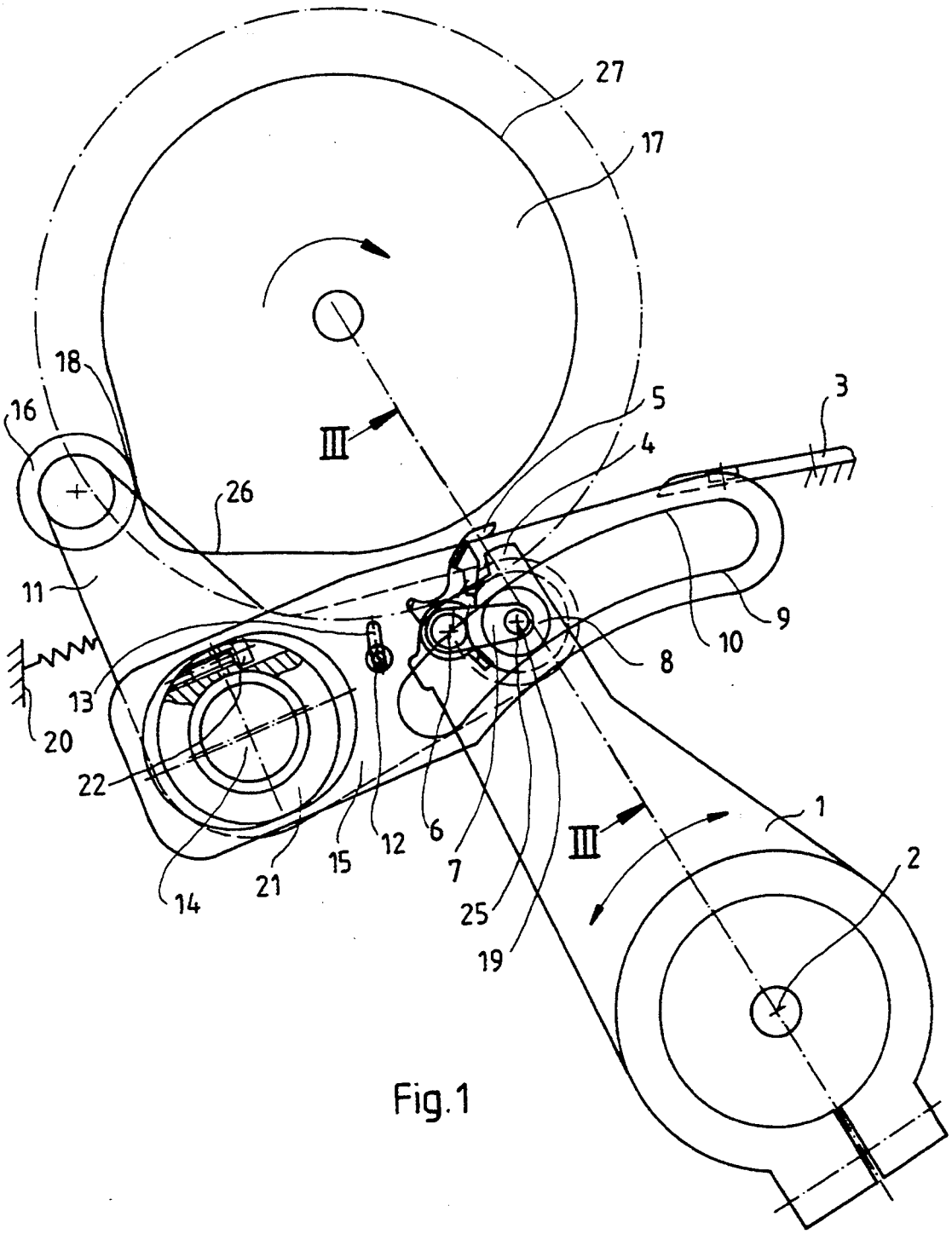
FIG. 1 is a diagrammatic side elevational view of the pre-gripper according to the invention in a gripper-open setting position thereof.
Figure 2:
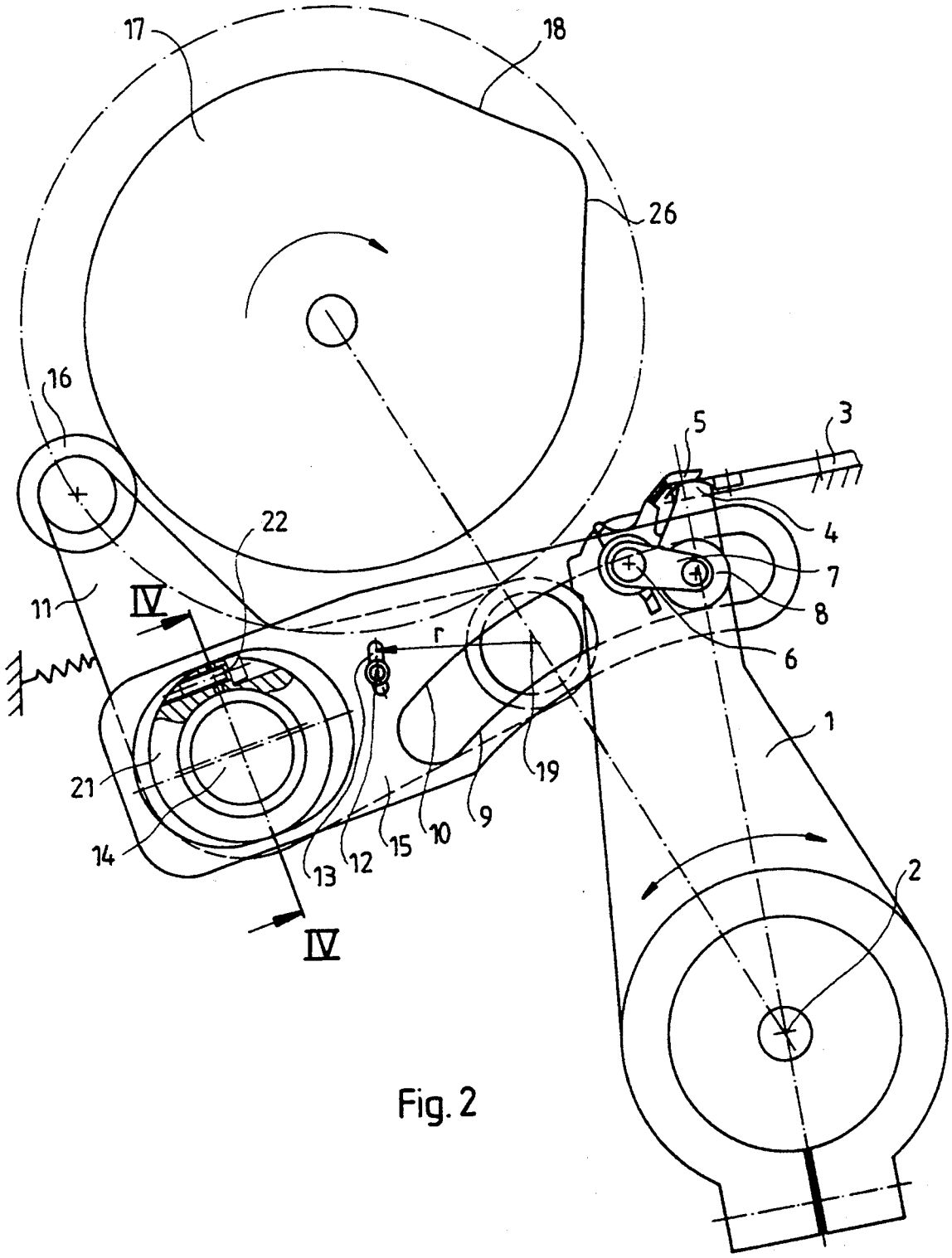
FIG. 2 is a view like that of FIG. 1 wherein the pre-gripper is in a different phase of operation thereof, namely in a gripper-closed setting position thereof.
Figure 3:
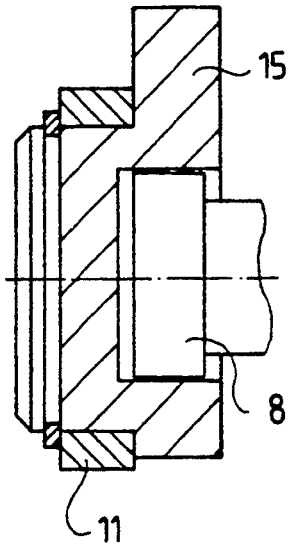
FIG. 3 is a fragmentary sectional view of FIG. 1 taken along the line III—III in the direction of the arrows.
Figure 4:
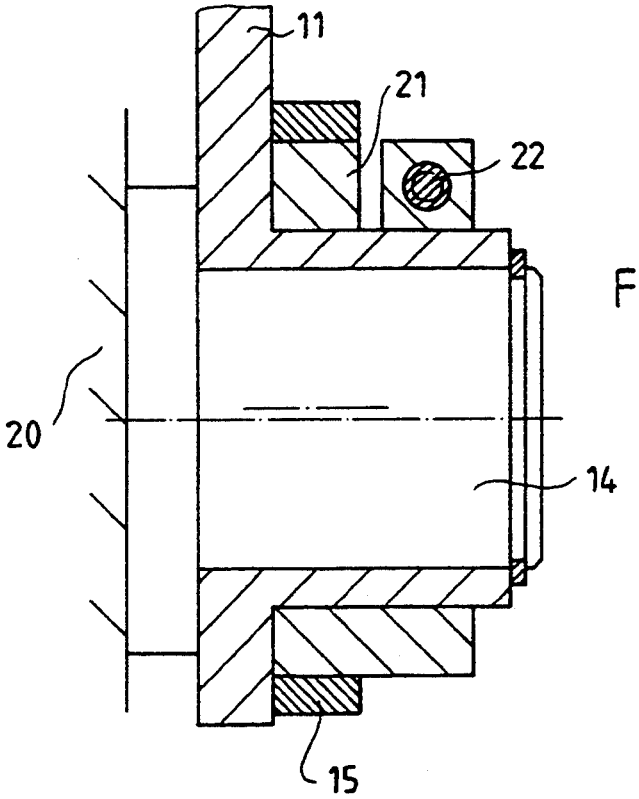
FIG. 4 is a fragmentary sectional view of FIG. 2 taken along the line IV–IV in the direction of the arrows.
Figure 5:
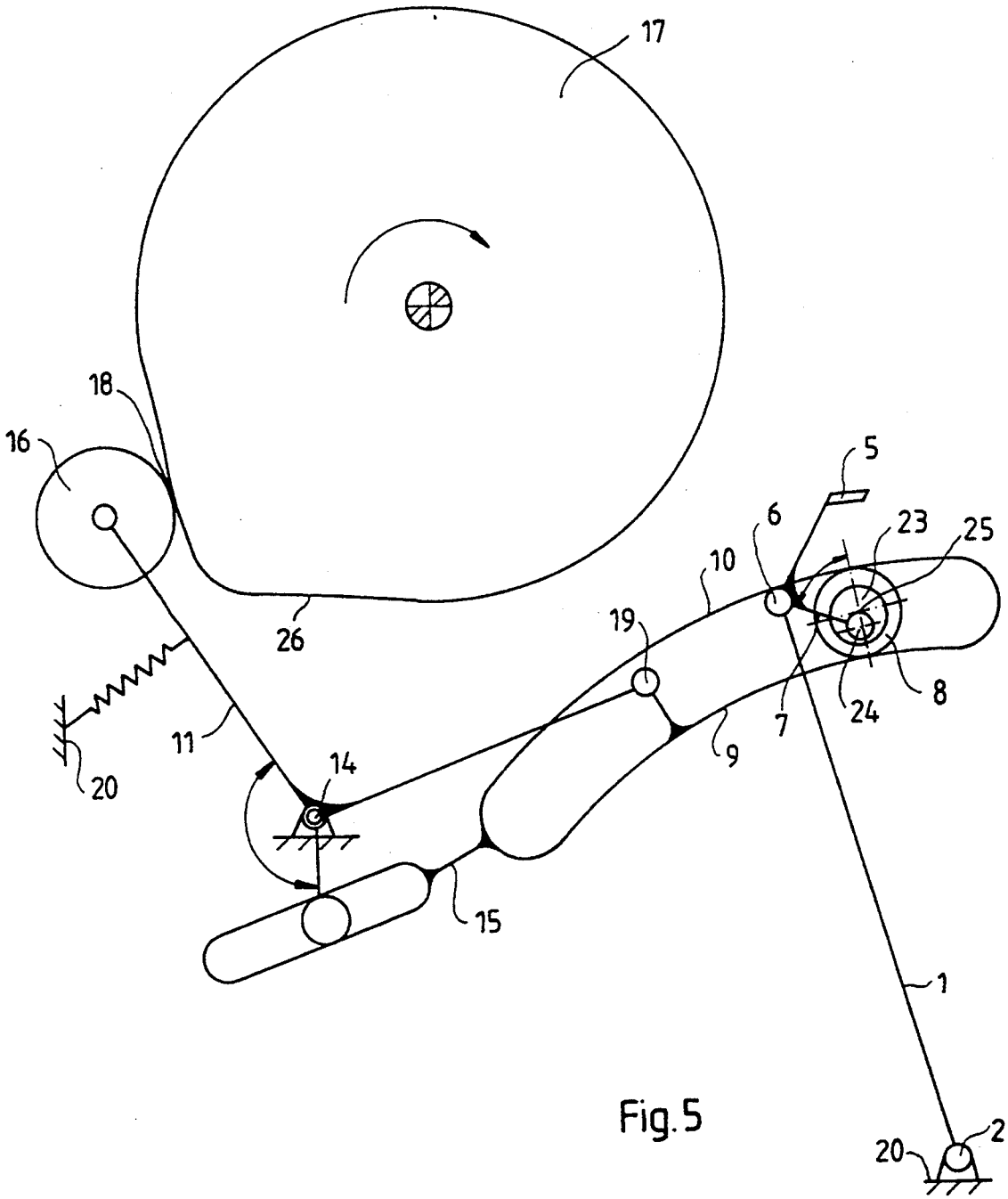
FIG. 5 is a schematic view of the pre-gripper for explaining the setting mechanisms thereof.

Referring now to the drawings and, first, particularly to FIGS. 1, 2 and 4 thereof, there is shown therein, in an otherwise non-illustrated sheet-fed rotary offset printing press, a feeding table 3, on which sheets are conveyed and aligned in a conventional manner by conventional non-illustrated means. Farther in the sheet-conveying direction, a swivel arm 1 of a pre-gripper is swivellably mounted on a cyclically driven shaft 2 journalled in side frames of the printing press. Gripper fingers 5 are attached, in a conventional manner, to a gripper shaft 6 journalled, likewise in a conventional manner, in the swivel arm 1. A lever 7 is fastened to the gripper shaft 6. As is represented in the schematic view of FIG. 5, an eccentric bushing 23 with a pin 24 is mounted in the lever 7. The eccentric bushing 23, in a conventional manner not otherwise illustrated, is swivellable about the axis of the pin 24 in the lever 7 and is lockable. A sensing or scanning roller 8 is rotatably mounted on the eccentric bushing 23. The sensing roller 8 is guided from two sides by mutually parallel cams 9 and 10. The cams 9 and 10 are part of a guide groove or slot, which is machined into a lever 15 carried by a bellcrank lever 11 on one arm there-of. The lever 15 is rotatably mounted in the bellcrank lever 11 at a center of rotation 19, as shown in FIG. 3. The bellcrank lever 11 is, in turn, rotatably mounted on a shaft stub 14 fastened to a frame 20 of the printing press. As is shown in FIG. 4, rotatably mounted on the lever 11, concentrically with the shaft stub 14, is an eccentric bushing 21, on which, in turn, the lever 15 is guided. By means of a clamping screw 22, the eccentric bushing 21 can be locked, in a conventional manner, on the lever 11. Rotatably mounted on the other arm of the bellcrank lever 11 is a sensing or scanning roller 16 which, by means of a spring braced against the printing-press frame 20, is in permanent contact engagement with a cam plate 17. The cam plate 17 is rotatably mounted in the printing press frame 20 and is driven in a conventional manner by a non-illustrated drive of the printing press. The cam plate 17 has a basically circular cam profile with a raised region or lobe 18 for opening the gripper finger 5 in order to release paper sheets gripped thereby.

Sheets which are conveyed across the feeding table 3 and aligned thereon, are accepted by the pregripper at the end of the feeding table 3. In this regard, the swivel arm 1 of the pre-gripper is swivelled about the shaft 2 towards and to the feeding table 3. The sensing roller 16 rolls downwardly from a most radially outwardly extending raised part 26 of the lobe 18 of the cam plate 17, and the sensing roller 8 rolls in the guide groove of the lever arm 15 along and between the cams 9 and 10 and, because of a continuous slope or inclination of the two cams 9 and 10, is swivelled by the lever arm 7 about the axis of the gripper shaft 6 downwardly towards the feeding table 3. The instant the sensing roller 8 has reached a specific or given deflection, as shown in FIG. 2, the gripper finger 5 comes to rest upon a gripper-pad surface 4 on the swivel arm 1, and the gap previously existing between the gripper finger 5 and the gripper-pad surface 4 is closed. The front edge of a paper sheet, which has been inserted between the gripper finger 5 and the gripper-pad surface 4 previously from the feeding table 3, is gripped between the gripper finger 5 and gripper-pad surface 4. Then, the swivel arm 1 is swivelled about the shaft 2, in a conventional manner, in the sheet-conveying direction, with the sensing roller 16 of the lever 11 rolling on the largely circular resting or neutral region of the cam plate 17 and with the sensing roller 8 rolling on the steadily slightly-rising region of the cams 9 and 10 formed in the lever arm 15. The instant the sensing roller 16 reaches the raised region 18 of the cam roller 17, the lever 11 swivels about the shaft stub 14 in accordance with the extent of rise afforded by the raised region 18, and the roller 8 is likewise deflected upwardly. The gripper finger 5 is thereby swivelled away from the gripper-pad surface 4 of the pre-gripper, and a gap is again formed and widened therebetween, so that the front edge of the paper sheet is again released. Thereafter, the paper sheet is conveyed, in a conventional manner, through the subsequent printing units by further conveying means. While the cam plate 17 is rotated further about its axis, and the sensing roller 16 thus rolls to the closing region 26 of the cam 17, the swivel arm 1 moves again to the feeding table 3. The instant the sensing roller 16 is again lowered towards the circular region of the cam plate 17, the swivel arm 1 is again swivelled into the acceptance or take-up position at the feeding table 3 for accepting the next sheet. The instant the sensing roller 16 and, thus, the sensing roller 8 have been swivelled down far enough, the gripper finger 5 has accordingly again been swivelled down to the pad surface 4 so as to grip the next sheet.

For effecting a precise adjustment or setting of the gripper opening after installation, the swivel arm 1 is swivelled into its sheet-transfer position in which the shaft 25 of the sensing roller 8 is disposed precisely on the swivel axis 19 on the lever 11. After releasing the locking of the eccentric bushing 23, the eccentric bushing 23 is swivelled about the axis of the pin 24 in the lever 7, in a conventional manner, so that the gripper fingers 5 are just removed from the pad surface 4. After the eccentric bushing 23 has been locked, the swivel arm 1 is swivelled into its acceptance or take-up position for accepting the next sheet from the feeding table 3, i.e., it is swivelled to the position in which the gripper fingers 5 are to close. In this position, after the clamping screws 12 and 22 have been loosened, the eccentric bushing 21 is so rotated by the shaft stub 14, and thus the lever arm 15 is so deflected about the center of rotation 19, that the gripper fingers 5 just touch the pad surface 4. After the clamping screws 12 and 22 have been tightened, the instant of gripper opening and the instant of gripper closing are set precisely for the selected, generally most usual paper thickness.

The deviations from paper thickness to paper thickness are minimal and do not result in any particular deviations in the instants of opening and closing of the gripper fingers 5.

In order to limit the swivelling angle of the lever arm 15 on the lever 11, a clamping screw 12 is provided which is fastened to the lever 11 and extends into a curved slot 13 formed in the lever 15 and is disposed therein concentrically to the center of rotation 19. The curved slot 13 is selected so that the cams 9 and 10 have a continuously falling profile with respect to the sensing roller 8 throughout the entire swivelling range in the sheet-conveying direction, thus excluding any possibility of an undesired opening of the gripper during the transport of the sheets.

Other measures to prevent an opening of the gripper are also conceivable. For example, the cams 9 and 10 might also have minimally rising regions to an extent that these rising regions are reliably compensated for so as to prevent any undesired opening due to a pretensioning or prestressing in the gripper system.

We claim:

1. Swivelling pre-gripper of a sheet-fed printing press having a sheet feeding table, the pre-gripper comprising a swivel arm; a gripper carried by the swivel arm; a mutually cooperating roller lever and cam mechanism for, respectively, opening and closing said gripper; means for cyclically swivelling said swivel arm of the pre-gripper to and away from the sheet feeding table; means for cyclically opening and closing said gripper; means for setting an instant of opening of said gripper for releasing a sheet gripped by said gripper in a closed condition thereof to downline conveying means for accepting and transporting the released sheet; means for setting, in a manner decoupled from the setting of the instant of opening, an instant of closing said gripper for gripping the sheet fed from the feeding table to the pre-gripper; one of said means for setting the instant of opening and said means for setting the instant of closing of said gripper being disposed on said roller lever; and the other of said means for setting the instant of closing and for setting the instant of opening of said gripper forming part of said cam mechanism for, respectively, opening and closing said gripper.

2. Swivelling pre-gripper according to claim 1, wherein said cam mechanism includes a uniformly rotatably driven opening cam, said roller lever is swivellably mounted and carries a sensing roller which is in continuous contact with said opening cam; a closing cam carried by said roller lever; a gripper-opening lever carried by said swivel arm of the pre-gripper; a sensing roller rotatably mounted on said gripper-opening lever, said sensing roller being in continuous contact with said closing cam.

3. Swivelling pre-gripper according to claim 2, wherein said closing cam carried by said roller lever is swivellable about a pivot point and settable and lockable for opening said gripper, and said sensing roller mounted on said gripper-opening lever is held in an eccentric, and including means for setting and locking said eccentric on said gripper-opening lever.

4. Swivelling pre-gripper according to claim 2, wherein said closing cam is swivellable about a pivot axis on said swivellably mounted roller lever; and including means for swivelling and means for locking said closing cam on said roller lever; said pivot axis, in the open condition of said gripper, coinciding with an axis of said sensing roller, and said sensing roller being in contact with said closing cam.

5. Method for setting an instant of opening and an instant of closing of a gripper on a pre-gripper of a sheet-fed printing press, which comprises swivelling the pre-gripper into one position selected from a closing position and an opening position, respectively, of the gripper; setting the gripper, in a first setting, so that, in the selected position, the gripper just closes and opens, respectively; swivelling the pre-gripper into the other of the respective opening and closing positions; and, independently of the first setting and without any reaction on the first setting, setting the gripper in a second setting, so that, in the selected position, the gripper just closes and opens, respectively.

6. Method according to claim 5, which comprises swivelling the pre-gripper into the opening position; setting the gripper, in a first setting, so that it just opens; swivelling the pre-gripper into the closing position; and, independently of the first setting and without any reaction on the first setting, setting the gripper then in a second setting so that, in the closing position, the gripper just closes.

7. Method according to claim 5, wherein the prep-gripper includes an opening cam, a closing cam and a sensing roller in continuous contact with the closing cam, and wherein the swivelling of the pre-gripper into the one position selected from the respective opening and closing positions includes swivelling the closing cam and the opening cam, respectively, about a point assumed by a sensing roller of the gripper on the closing cam and opening cam, respectively, in a coordinate system movable with the respective opening cam and closing cam and having an origin in a swivelling axis of the closing cam at the first setting.

* * * * *